US005782094A

United States Patent [19]

Freeman

[11] Patent Number: 5,782,094

[45] Date of Patent: Jul. 21, 1998

[54] REFRIGERATED COUNTERTOP SNACK CONTAINER

[76] Inventor: Pamela R. Freeman, 721 Alverston Ave., Ventura, Calif. 93003

[21] Appl. No.: 805,924

[22] Filed: Feb. 25, 1997

[51] Int. Cl.[6] ..... F25B 21/02

[52] U.S. Cl. ..... 62/3.6; 62/457.9

[58] Field of Search ..... 62/3.2, 3.3, 3.6, 62/3.62, 3.7, 457.9, 371

[56] References Cited

U.S. PATENT DOCUMENTS

| | | | |
|---|---|---|---|
| 2,991,628 | 7/1961 | Tuck | 62/3.62 |
| 3,168,816 | 2/1965 | Petrie | 62/3.6 |
| 4,326,383 | 4/1982 | Reed et al. | 62/3.62 |
| 4,823,554 | 4/1989 | Trachtenberg et al. | 62/3.62 |
| 5,029,446 | 7/1991 | Suzuki | 62/3.6 |
| 5,456,164 | 10/1995 | Bang | 99/468 |
| 5,524,440 | 6/1996 | Nishioka et al. | 62/3.6 |
| 5,661,979 | 9/1997 | DeBoer | 62/3.6 |

FOREIGN PATENT DOCUMENTS

| | | | |
|---|---|---|---|
| 299714 | 11/1971 | U.S.S.R. | 62/3.6 |

*Primary Examiner*—William Doerrler
*Attorney, Agent, or Firm*—J. E. McTaggart

[57] ABSTRACT

A refrigerated countertop snack container that can be styled in the form of a lidded cookie jar utilizes a Peltier effect thermoelectric element as the cooling module located beneath the main interior compartment formed by a hygienic thermally-conductive liner that is thermally insulated from the container's outer shell and is held at 38° F. nominal for optimal food refrigeration. The liner is specially designed with tapered thickness to minimize bottom-to-top temperature difference. Heat generated by the refrigeration process is dissipated from a finned aluminum heat sink that is cooled by forced air from a quiet "muffin" fan drawing in air from a first set of air vent openings configured around a lower region of the container, and exhausting air, warmed by the heat sink and fan motor, through a second set of air vents located above the first set. A high frequency type switching power converter located in the bottom region of the container converts 115 volts a.c. from the domestic power line to about 12 volts d.c. to power the thermoelectric element and the fan, and provides electrical isolation from the power line.

18 Claims, 3 Drawing Sheets

REFRIGERATED COUNTERTOP SNACK CONTAINER

FIELD OF THE INVENTION

The present invention relates to the field of household appliances, and more particularly it relates to a small refrigerated container for snacks such as fruits and vegetables.

BACKGROUND OF THE INVENTION

In many households, especially where there are growing children, between-meal snacks are frequent, resulting in frequent intrusions into the kitchen refrigerator that tend to be disruptive and wasteful of energy along with a certain amount of wear and tear on the refrigerator that could lead to premature service requirements.

Furthermore many homemakers would prefer to automatically encourage both children and adults to snack on fruits, vegetables and/or other nutritional foods instead of the wider range of temptations that might present themselves in a refrigerator raid.

This invention recognizes and addresses a growing but unfulfilled need for a refrigerated countertop snack container that would conveniently and beneficially replace the kitchen refrigerator as the household focal point for snacking.

Conventional motor-driven compressor type refrigeration units tend to be too noisy and are otherwise unsuited to the small size of the product envisioned for this invention, however Peltier effect thermoelectric elements are available that can silently perform refrigeration when a correctly polarized direct electric current is made to flow through the junction of two different selected metal materials.

DISCUSSION OF RELATED KNOWN ART

U.S. Pat. No. 5,423,194 to Senecal discloses a food service bowl chilled by a miniature refrigeration system and air fan.

In other known prior art in the field of small refrigerated containers, the Peltier principle is utilized in its cooling mode, e.g. U.S. Pat. Nos. 4,581,898 to Preis, 5,421,159 to Stokes, 4,383,414 and 4,143,711 to Beitner.

The reversible feature of the Peltier effect has been utilized to provide containers with both chilling and warming capabilities: e.g. in U.S. Pat. Nos. 4,320,626 to Donnelly and 4,823,554 to Trachtenberg et al. Design patent 352,420 to Costello shows a thermoelectric heater and cooler unit for food.

OBJECTS OF THE INVENTION

It is a primary object of the present invention to provide a relatively small chilled container with an enclosed but accessible storage region for fruits, vegetables and/or other snack foods.

It is a further object to provide the chilled container with cooling means for maintaining the storage region at constant temperature, e.g. in a range between 35° F. and 42° F. with a room ambient temperature up to 75° F.

It is a further objective to provide capability of lowering the interior temperature of the container with a typical food load from room temperature of 75° F. to 38° F. in a transition time of about 2 hours.

It is a further object to enable the cooling means to operate from a standard 115 volt a.c. household electric power line.

It is a further object for the cooling means to be relatively quiet in operation.

It is a further object to provide the container in a decorative outer shell, with a removable cover, that encloses the cooling means as well as the storage region.

It is a further object to provide a non-porous cleanable surface on the outside housing and lid, and to provide an easily cleanable hygienic surface in the internal storage region.

SUMMARY OF THE INVENTION

The above objects have be met in the refrigerated counter top snack container of the present invention utilizing a Peltier effect thermoelectric element cooled by forced air from a quiet "muffin" fan. A high frequency switching-type power converter operating from the 115 volt domestic a.c. power line delivers a shock-hazard-isolated d.c. voltage for powering the thermoelectric element and the fan. The storage region is formed by a thermally conductive metal inner liner that is thermally insulated from the outer shell of the container. The liner is in thermal contact with the cold side of the thermoelectric element; its temperature is automatically controlled to 38° F. nominal with the bottom-to-top temperature difference is held to within 2° F. by a thermally-designed tapered-thickness liner configuration. Heat removed from the bottom of the liner by the thermoelectric cooler is dissipated from the hot side of the thermoelectic unit by a finned aluminum heat sink cooled by the fan drawing in room air from a first set of air vent openings provided around a lower region of the container, and exhausting warmed air through a second set of air vents located above the first set. A horizontal baffle plate surrounding the fan separates the incoming flow of room air from the exhaust flow of heated air.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
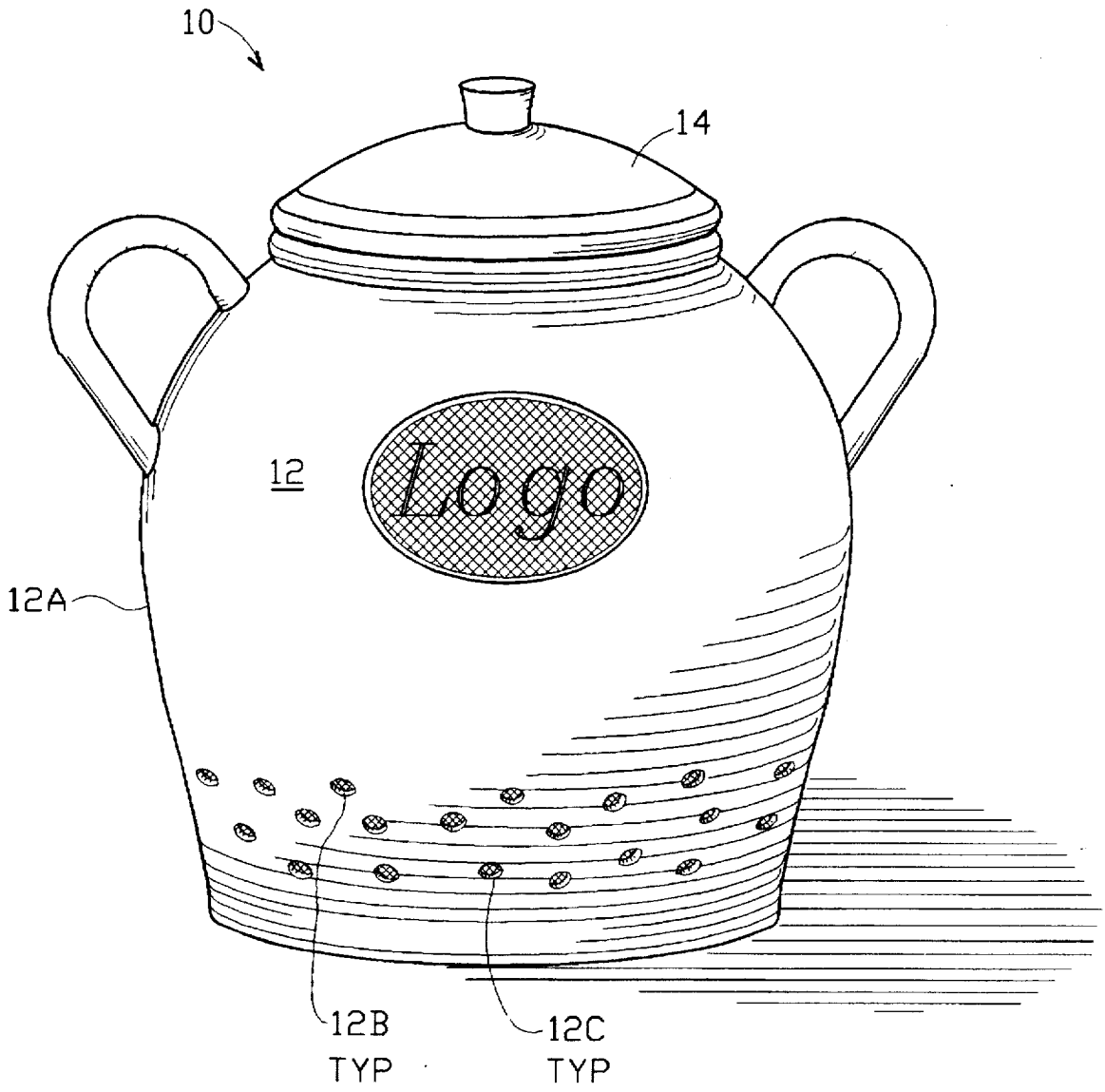
FIG. 1 is a perspective view of a refrigerated snack container in an illustrative embodiment of the present invention.

In FIG. 1 a refrigerated container 10, shown in a perspective view, represents an illustrative embodiment of the present invention, having a main body 12 and a lid 14. In a lower region of the outer shell 12A of main body 12, a pattern of openings 12B and 12C serve as air outlet and intake vents respectively for the internal refrigeration system, located in the lower region of main body 12.

Figure 2:
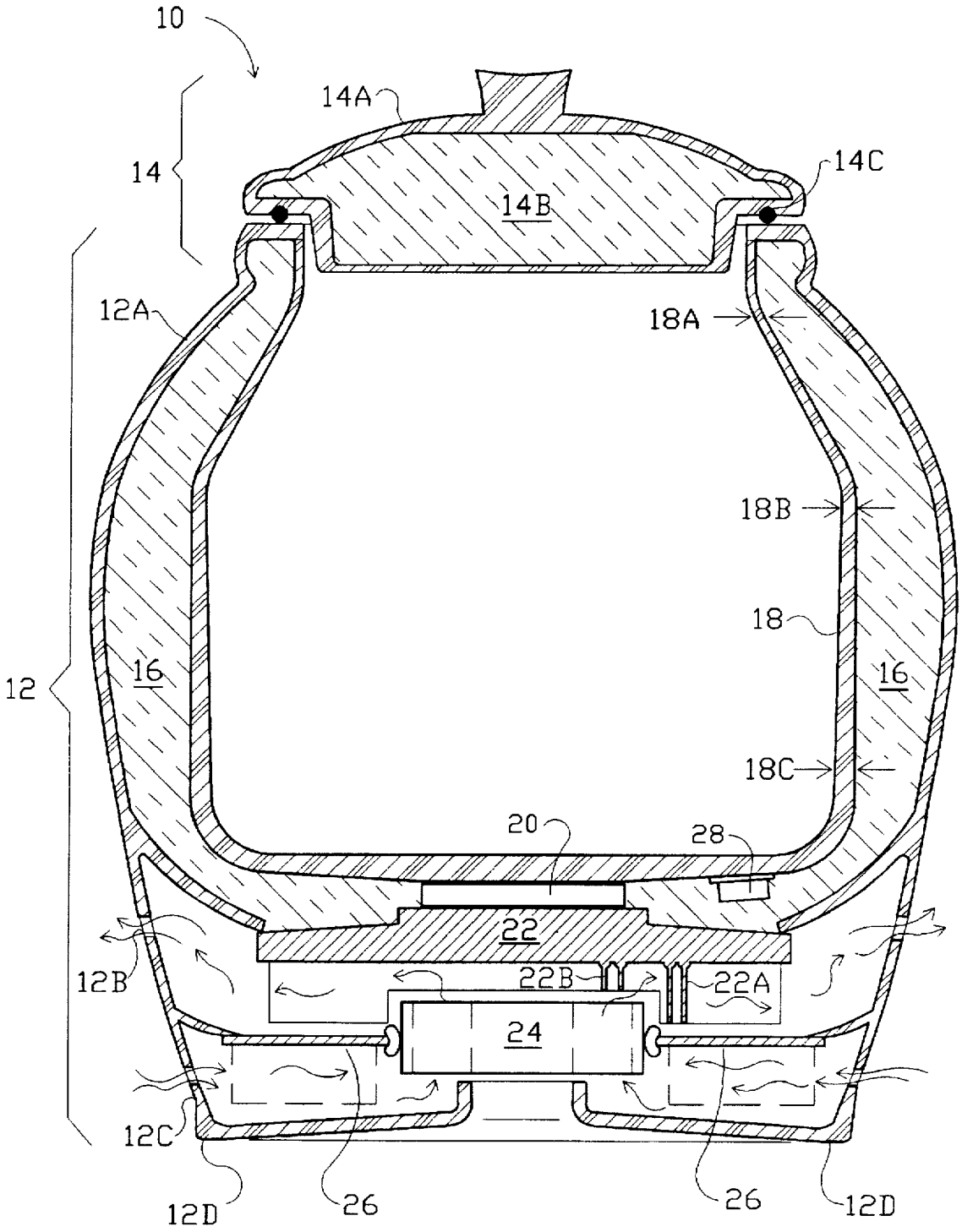
FIG. 2 is a cross-sectional view taken centrally through the refrigerated container of FIG. 1.

In FIG. 2, a cross-sectional view taken through a central axis of container 10 of FIG. 1, outer shell 12A is isolated thermally by insulation material 16 from a thermally conductive liner 18 which is strongly coupled thermally to the "cold" pad of a Peltier effect thermoelectric element 20, whose lower "hot" pad on the opposite side is strongly coupled thermally to a metallic heat sink 22. Typically liner 18 and heat sink 22 are made from aluminum for superior heat conductivity and tapered in thickness as shown so as to provide maximum thermal conductivity in the region of element 20 while holding the bottom-to-top temperature difference in liner 18 under a designated maximum, e.g. 2° F. Typical wall thickness for liner 18 is 0.060" at location 18A increasing to 0.125" at 18B and 18C and further increasing to 0.25" at device 20. In this region, heat sink 22 is typically made to have a thickness of 0.375". Fins 22A and 22B formed integrally on heat sink 22 extend downwardly and are cooled by forced air from a muffin fan 24 surrounded by a baffle plate 26 which directs the air flow in the path indicated by arrows, isolating room temperature air, entering from below through vents 12C, from the warmed exhaust air being forced by the muffin fan upward and outward through vents 12B located above. Heat sink fins 22B in the central region above fan 24 are made in reduced height to make room for the fan 24. Turbulent air flow from fan 24 breaks down stagnant boundary air layers around heat sink fins 22A and 22B.

Baffle plate 26 also serves to mount electronic power supply components in the locations indicated by dashed lines.

A temperature-sensing control element 28 is mounted on the underside of liner 18.

The bottom portion of the main body 12 of container 10 is formed to provide peripheral support foot structure 12D typically configured as a circular protrusion or a circular array of protrusions.

Lid 14A is preferably filled with thermal insulation material 14B and sealed around the edge by a ring 14C of neoprene or equivalent flexible gasket means to avoid heat leakage.

Figure 3:
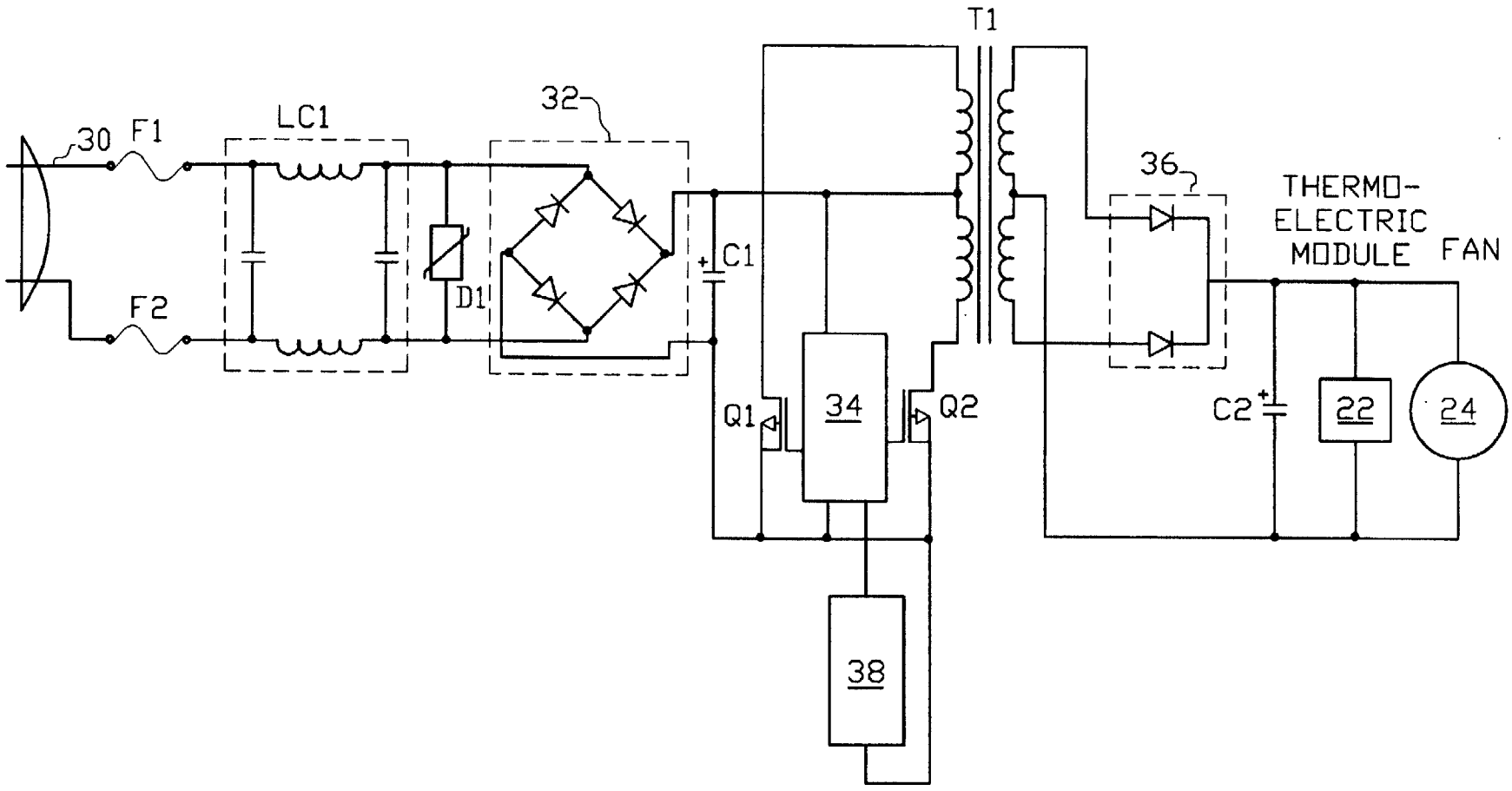
FIG. 3 is a schematic block diagram of the electrical system of the refrigerated container of FIGS. 1 and 2.

In FIG. 3, the schematic diagram of the electrical system of the refrigerated container of FIGS. 1 and 2 shows the a.c. power line 30 entering through a pair of fuses F1 and F2, an EMI (electro-magnetic interference) filter LC1 to a full wave bridge rectifier unit 32 protected at its input by a transient/surge limiting diode D1.

The d.c. output of rectifier unit 32, about 130 volts, is filtered by capacitor C1 and applied to driver module 34 which generates high frequency a.c. waveform that controls a pair of FET (field effect transistor) switches, Q1 and Q2, so as to apply the d.c. voltage (across capacitor C1) alternately to each half of the primary of transformer T1.

The high frequency output at the secondary of transformer T1, rectified by full wave rectifier unit 36, supplies d.c. output at 12 volts nominal, filtered by capacitor C2 and applied to thermoelectric element 20 and the motor of fan 24.

The amplitude of the d.c. output voltage at capacitor C2 is controllable via a control input to driver module 34, typically by varying pulse width and/or frequency: an automatic control loop is formed by connecting a thermostatic control element 38 to the control input of module 34 as shown.

Control element 38 may a thermostatic switch which cycles the power supply between on/off or full/partial power. Alternatively, continuous proportional control can be provided by selecting a suitable thermistor for element 38. In either case, the control loop is designed to maintain the interior temperature within a desired range, e.g. 35° F. to 42° F.

In a thermal analysis it is estimated that in maintaining a temperature difference of 35° F. (73° F. room −38° F. container), the container heat loss is 7.1 watts, based on a container interior size 6" diameter by 6" high insulted by foam ⅝" thick having thermal conductivity 0.035 W/m. For this condition, the power input requirement from the 115 volt a.c. power line can be calculated by making allowance for efficiencies of the Peltier module (30% to 35%) and the switching power converter (about 90%) and the power consumed by the cooling fan motor (about 2 W): thus the static condition alone, i.e. merely maintaining a constant 38° F. temperature, is estimated to require about 30 watts.

However additional heat flow and input power must be provided for the dynamic aspect of initially cooling the air and food load in the container, the main criteria being the transition time required to accomplish cooling from room temperature down to 38° F. Also important is temperature rise of the cooling air, i.e. from ambient at the intake to the warm air exhausted. The heat sink performance and the quality of the interface thermal coupling on both sides of the Peltier module 20 are critical, especially the heat sink and its cooling fan on the hot side where the heat flow is nearly four times that of the cold side due to the relatively low efficiency of the Peltier module 20, typically 30% to 35%. With 35% efficiency in module 20, a transition time in the order of 2 hours requires a switching power supply that can deliver up to about 50 watts, a muffin or turbine fan that can deliver 8.2 SCFM air flow and a fairly effective heat sink configuration such as that indicated above. To reduce this transition time appreciably could require a larger power supply rating, increased cooling fan flow capability and/or increased heat sink effectiveness to limit the exhaust air temperature rise to preferably less than 10° C. above ambient.

Peltier effect modules are supplied by Melcor Corporation, e.g. PT4-12-30 and PT4-12-40, the latter being more efficient and higher in cost.

Instead of the switching-type high frequency power converter built into the container as shown and described above, the invention can be practiced with any suitable d.c. source and the source could be located external to the container, for example a regular transformer type d.c. power supply operating at power line frequency, e.g. 60 Hz, if the disadvantages in total size, weight and convenience can be accepted.

The invention can be practiced with a wide range of external shapes and styles differering from the illustrative embodiment described and shown.

The outer shell 12A of the main container body 12 may be made of any material that gives the desired appearance and provides a non-porous cleanable surface. Many ceramics, metals and plastics are known to meet these requirements.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A refrigerated container for storing and dispensing chilled snack foods from a countertop location, comprising:

a container body;

an outer shell forming an exterior surface of said container body;

an inner liner of said container body, contained within said outer shell and thermally insulated therefrom, forming a storage region for snack food, said inner liner being made from thermally conductive material and made to be tapered in thickness, being made thinnest in a top region and increasing in thickness to a thickest portion at a bottom region configured to have a downward-facing thermal input interface pad, whereby uniformity of temperature distribution throughout the storage region is enhanced by expediting transfer of corrective temperature changes from the thermal input interface pad to the top region;

a cover on said container providing user access to the storage region;

a Peltier-effect thermoelectric element, having a thermal pad, known as the cold pad, thermally coupled to the thermal input interface pad of said inner liner, and having a second thermal pad, known as the hot pad, located opposite the first thermal pad;

a source of electrical direct current directed through said thermoelectric element so as to absorb heat at the cold pad and to generate heat at the hot pad; and heat sink means, coupled thermally to the hot pad, constructed and arranged to transfer heat therefrom to environmental air surrounding said container;

whereby the storage region is caused to be cooled relative to the surrounding environmental air.

2. The refrigerated container as defined in claim 1, wherein:

said container body is configured to be generally cylindrical and to have a substantially vertical peripheral wall portion;

said inner liner is configured to have a substantially flat bottom portion extending contiguously to the wall portion;

said thermoelectric element is centrally disposed immediately beneath the bottom portion of said inner liner;

said heat sink means is disposed immediately beneath said thermoelectric element;

said outer shell extends downwardly beyond the bottom portion of said inner liner so as to surround said thermoelectric element and said heat sink means, and said outer shell is made to provide a non-porous easily-cleaned exterior surface of said container body.

3. The refrigerated container as defined in claim 2, wherein the cover is configured as a removable circular lid, retained in a mating circular opening in a top region of the wall portion of said container body.

4. The refrigerated container as defined in claim 3 wherein said lid is retained gravitationally and wherein said container further comprises a resilient sealing ring disposed peripherally between the lid and the top region of the wall portion.

5. The refrigerated container as defined in claim 2, wherein said container body further comprises a core of thermally insulating material, disposed between said inner liner and said outer shell, formulated and arranged to minimize heat transfer therebetween.

6. The refrigerated container as defined in claim 2, wherein said heat sink means comprises a heat sink unit configured as a generally horizontal plate of thermally conductive material having a plurality of integral cooling fins extending downwardly, arranged in a pattern for cooling said heat sink assembly by a flow of air entering into the central region of said heat sink unit and exiting outwardly in a radial flow pattern.

7. The refrigerated container as defined in claim 6, wherein said heat sink means further comprises a muffin cooling fan, disposed centrally beneath said heat sink unit, constructed and arranged to direct cooling air upwardly onto said heat sink unit and outwardly therefrom.

8. The refrigerated container as defined in claim 7 wherein said source of electrical direct current comprises a high frequency switching-type power converter constructed and arranged to convert 115 volts a.c. from a domestic power line to a d.c. output voltage supplied to said thermoelectric cooling element.

9. The refrigerated container as defined in claim 8 wherein said power converter further comprises a control input port from which the d.c. output voltage can be varied, and wherein said container further comprises temperature-sensing means thermally coupled to said inner liner and operatively connected to said control input port in a manner to form an automatic temperature control loop that acts to maintain the storage region at a predetermined constant temperature.

10. The refrigerated container as defined in claim 9 wherein said temperature-sensing means is a thermistor having characteristic values designated such as to cooperate with said power converter in a manner to maintain the temperature in the storage region at the predetermined constant temperature.

11. The refrigerated container as defined in claim 10 wherein the predetermined constant temperature is designated to be 38° F. nominal.

12. The refrigerated container as defined in claim 9 wherein said temperature-sensing means is a thermostatic switch calibrated to cooperate with said power converter in a manner to maintain the storage region at the predetermined constant temperature.

13. The refrigerated container as defined in claim 12 wherein the predetermined constant temperature is designated to be 38° F. nominal.

14. The refrigerated container as defined in claim 6 further comprising a horizontal baffle plate surrounding said muffin fan, constructed and arranged to isolate incoming air at room temperature from exhaust air heated by said heat sink means.

15. The refrigerated container as defined in claim 14 wherein said outer shell is configured to have an array of intake air vent openings disposed in a lower region thereof, shaped, sized and arranged to facilitate flowing of intake air drawn inwardly by said muffin fan from an outer region surrounding said container, and an array of exhaust air vent openings disposed above said intake air vent openings, shaped, sized and arranged to facilitate flowing of exhaust air propelled outwardly by said muffin fan.

16. A refrigerated container for storing and dispensing chilled snack foods from a countertop location, comprising:

a container body having an exterior shell with a non-porous easily-cleaned surface and forming a generally cylindrical and generally vertical peripheral wall portion;

an inner liner of said container body, contained within said outer shell and thermally insulated therefrom, configured to have a smooth hygienic inner surface and a substantially flat bottom portion extending contiguously to the wall portion, constructed and arranged to provide a refrigerated storage region for snack foods, said inner liner being made from thermally conductive material and tapered in thickness, being made thinnest in a top region and increasing in thickness to a thickest portion at a bottom region configured to have a downward-facing thermal input interface pad thermally coupled to the cold pad of said thermoelectric element, so as to enhance temperature uniformity throughout said storage region by expediting transfer of corrective temperature changes from the thermal input interface pad to the top region;

a removable circular lid, retained in a mating circular opening in a top region of the wall portion of said container body, providing user access to the storage region;

a Peltier-effect thermoelectric element, centrally disposed immediately beneath the bottom portion of said inner liner, having an upwardly-facing thermal cold pad thermally coupled to the thermal input interface pad of said inner liner, and having a hot pad, located opposite the cold pad and facing downwardly;

a heat sink unit, disposed immediately beneath the hot pad and coupled thermally thereto, configured as a generally horizontal plate of thermally conductive material having a plurality of integral cooling fins extending downwardly, arranged in a pattern to facilitate cooling of said heat sink unit;

a muffin cooling fan, disposed centrally beneath said heat sink unit, constructed and arranged to direct cooling air upwardly into a central region of said heat sink unit and past the cooling fins to exit outwardly in a radial flow pattern to a region of environmental air surrounding said container;

a horizontal baffle plate surrounding said muffin fan, constructed and arranged to isolate incoming room temperature air from exhaust air heated by said heat sink unit, said outer shell being made to extend downwardly beyond the bottom portion of said inner liner so as to surround said thermoelectric element, said heat sink unit, said fan and said baffle plate;

an array of intake air vent openings disposed in a lower region of said outer shell, shaped, sized and arranged to facilitate flowing of intake air drawn inwardly by said muffin fan from an outer region surrounding said container;

an array of exhaust air vent openings disposed above said intake air vent openings, shaped, sized and arranged to facilitate flowing of exhaust air propelled outwardly by said muffin fan; and a high frequency switching-type power converter constructed and arranged to convert 115 volts a.c. from a domestic power line to an electrically-isolated source of direct current directed through said thermoelectric element so as to absorb heat at the cold pad and to generate heat at the hot pad.

17. The refrigerated container as defined in claim 16 wherein said power converter further comprises a control input port from which the d.c. output voltage can be varied, and wherein said container further comprises temperature-sensing means thermally coupled to said inner liner and operatively connected to said control input port in a manner to implement an automatic temperature control loop that acts to maintain the storage region at a predetermined substantially constant temperature.

18. The refrigerated container as defined in claim 17 wherein the predetermined substantially constant temperature is designated to be 38° F. nominal.

* * * * *